US005611463A

United States Patent [19]

Favre

[11] Patent Number: 5,611,463

[45] Date of Patent: Mar. 18, 1997

[54] DOUBLE DISPENSER FOR FLUID PRODUCTS

[75] Inventor: Bernard Favre, Chevilly-Larue, France

[73] Assignee: Lir France, S.A., Chevilly-Larue, France

[21] Appl. No.: 501,314

[22] Filed: Jul. 12, 1995

[30] Foreign Application Priority Data

Jul. 12, 1994 [FR] France ..... 94 08610

[51] Int. Cl.[6] ..... B67D 5/42

[52] U.S. Cl. ..... 222/137; 222/145.1; 222/260; 222/494

[58] Field of Search ..... 222/135, 137, 222/145.1, 145.3, 145.4, 256, 260, 321.1, 321.7, 321.9, 383.1, 385, 387, 490, 494

[56] References Cited

U.S. PATENT DOCUMENTS

| | | | |
|---|---|---|---|
| 4,099,651 | 7/1978 | Von Winkelmann | 222/494 X |
| 4,773,562 | 9/1988 | Gueret | 222/145.1 X |
| 4,826,048 | 5/1989 | Skorka et al. | 222/137 |
| 5,102,016 | 4/1992 | Ball et al. | 222/145.3 |
| 5,154,328 | 10/1992 | Gueret | 222/494 |
| 5,197,637 | 3/1993 | Naumann | 222/494 X |
| 5,301,841 | 4/1994 | Fuchs | 222/145.1 X |

FOREIGN PATENT DOCUMENTS

| | | | |
|---|---|---|---|
| 0427609 | 5/1991 | European Pat. Off. . | |
| 0452260A2 | 10/1991 | European Pat. Off. | 222/494 |
| 0497256 | 8/1992 | European Pat. Off. . | |
| 0520315A1 | 12/1992 | European Pat. Off. | 222/137 |
| 0598637 | 5/1994 | European Pat. Off. . | |
| 2641337 | 6/1990 | France . | |
| 2650562 | 2/1991 | France . | |
| 2697233 | 4/1994 | France | 222/144.5 |
| 93 02 196.8 | 7/1994 | Germany . | |

*Primary Examiner*—Andres Kashnikow
*Assistant Examiner*—Kenneth Bomberg
*Attorney, Agent, or Firm*—Young & Thompson

[57] ABSTRACT

A double dispenser for fluid products, comprising, in a single casing (1), two chambers (2) filled with different fluids and each closed by a pump (3) provided with a valve, the two valves being actuated by a single pusher (5). The pusher (5) has a chamber into which open the outlets of the two valves. This chamber is divided by a wall (7) so as to form two separate chambers (6', 6") into which open respectively the outputs of the two valves. The wall (7) has two outlet openings (8', 8") respectively connected to the separate chambers (6', 6"). These outlet openings (8', 8") open into cavities (10', 10") of a dispensing nose (11) of elastically deformable material. The dispensing nose (11) has an outlet slot (12) sealingly closed by two lips (13) arranged to spread under the pressure of the mixed fluid arriving respectively in the cavities (10', 10") during depression of the pusher (5). The dispensing nose (11) comprises an intermediate partition (14) separating the cavities (10', 10"). This intermediate partition (14) is made of a single piece with the dispensing nose (11).

4 Claims, 2 Drawing Sheets

DOUBLE DISPENSER FOR FLUID PRODUCTS

The invention relates to a double dispenser for fluid products of the type comprising, in a single casing, two chambers filled with different fluids and each closed by a pump provided with a valve, the two valves being actuated by a common pusher, said pusher being provided with a chamber into which open the outlets of the two valves and which comprises an outlet opening for the mixture of the fluids.

These dispensers are generally used for creamy, liquid or pasty cosmetics and have the advantage that the mixture of the fluid products takes place before expulsion, such that the mixed product has the appearance of a single product at the outlet.

Most of these dispensers however have the drawback that the mixing chamber is open to ambient air and that the mixture which remains after one expulsion and until a following expulsion is subject to oxidation, which is undesirable even for pure products but, in the case of a mixture of two pure products, can give rise to chemical reactions between the components.

There is known from FR-A-2,650,562, a double dispenser comprising an outlet opening for the products, sealed from air other than during dispensing, but in which the two products are expelled by means of two parallel channels up to the outlet, and, as a result, without mixing said products.

There is also known, from EP-A-0.598.637 of the applicant, a mixer-dispenser with variable dosage permitting the dispensing of a mixture of products in different proportions. This dispenser has an outlet valve sealed from the air at the point where mixing of the products takes place. However, although the sealing is effected within the mixing chamber thereby avoiding oxidation of the products, a degradation of the products can result from the instability of the mixture obtained which can arise and can cause as a result pollution during further dispensing.

The present invention has for its object to overcome these drawbacks of known pumps.

To this end, the dispenser according to the invention comprises in a single casing, two chambers filled with different fluids and each closed by a pump provided with a valve, the two valves being actuated by a single pusher, said pusher being provided with a chamber into which open the outlets of the two valves, said chamber being divided by a wall so as to form two separate chambers into which open respectively the outlets of the two valves, said wall comprising two outlet openings connected respectively to said separate chambers, said outlet openings opening respectively into cavities of a dispensing member of an elastically deformable material, said dispensing member comprising an outlet slot closed in a sealed manner by lips arranged to spread under the pressure of the fluid arriving respectively in the cavities during depression of the pusher, characterized in that the dispensing member comprises an intermediate partition separating the cavities.

With a dispenser according to the invention, the mixture of the two fluids no longer takes place before expulsion but at the very moment of this expulsion, during passage through the outlet slot, such that the fluids remaining in the different channels after dispensing of mixed product are shielded from the air.

The intermediate partition is preferably formed from a single piece with the dispensing nose.

The wall is formed of one piece with the pusher and in particular it can be adjusted and welded to this latter.

It also extends in a preferred manner from the chamber that it divides into two separate chambers, to the cavity of the dispensing member, such that the mixture of the two fluids takes place only at the moment of expulsion of the fluids. Thus, in the case of two fluids which are not sufficiently stable when mixed with each other, the double dispenser according to the invention permits keeping the two fluids separate thereby avoiding any risk of any loss of effectiveness of the fluids.

The invention will now be described in greater detail with reference to the accompanying drawings in which.

Figure 1:
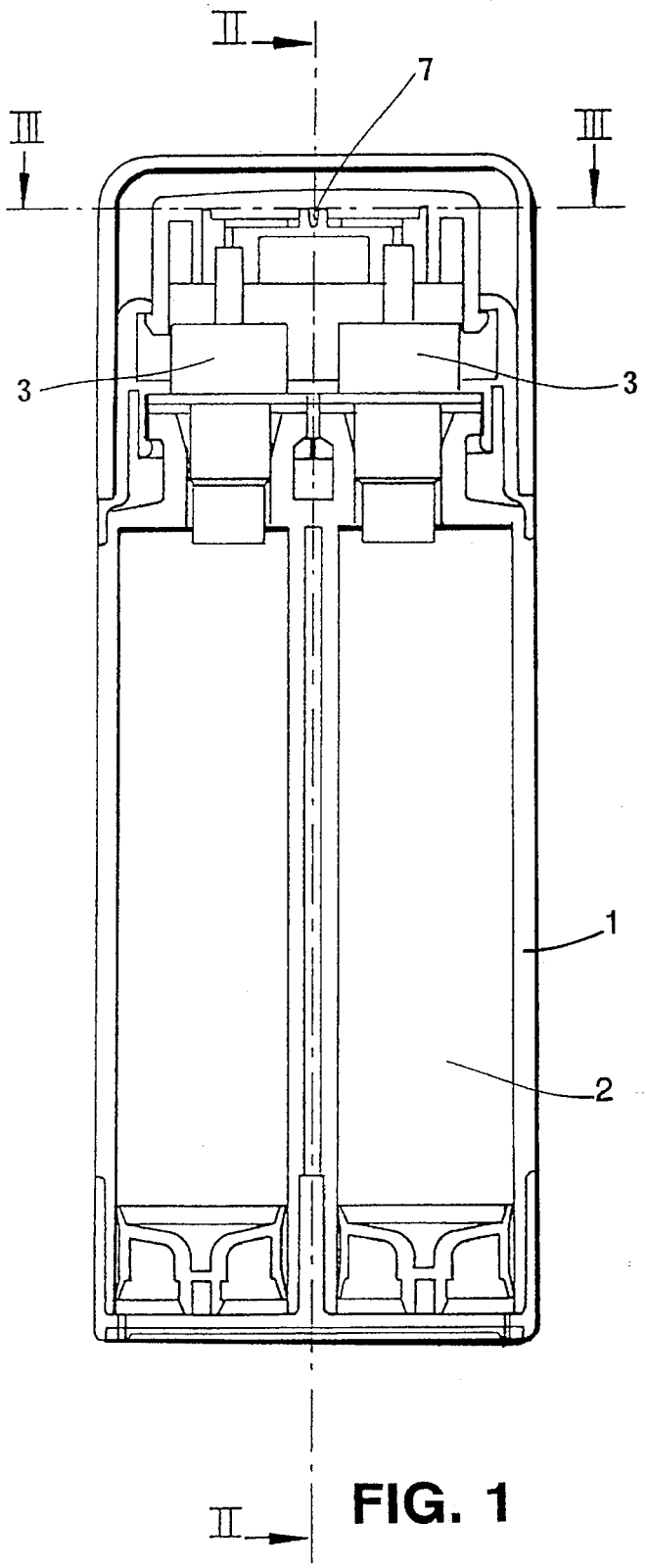
FIG. 1 is a longitudinal cross-sectional view of a dispenser according to an embodiment of the invention having two reservoirs.
Figure 2:
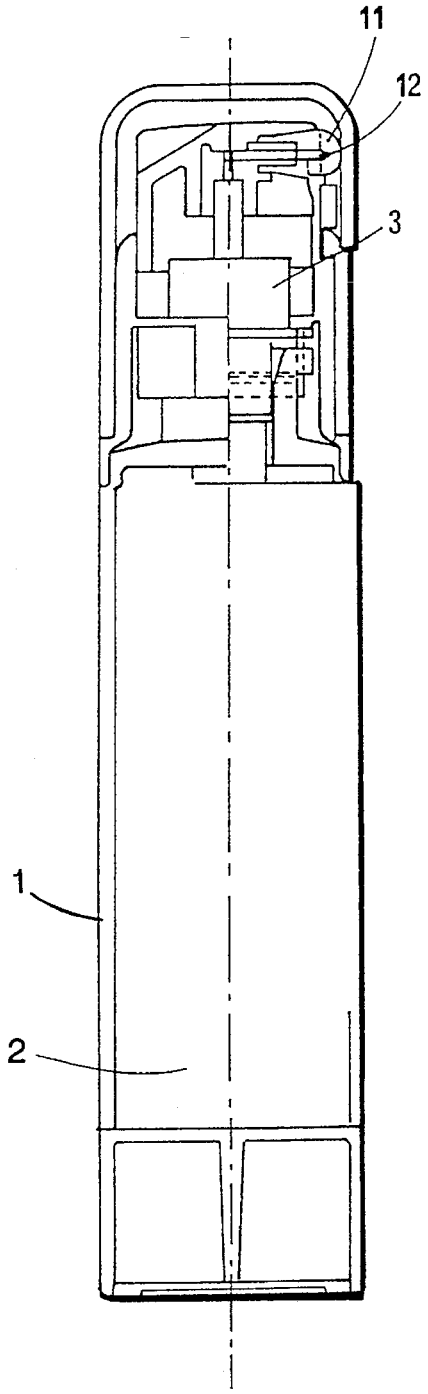
FIG. 2 is a cross-sectional view on line II—II of the dispenser of FIG. 1.
Figure 5:
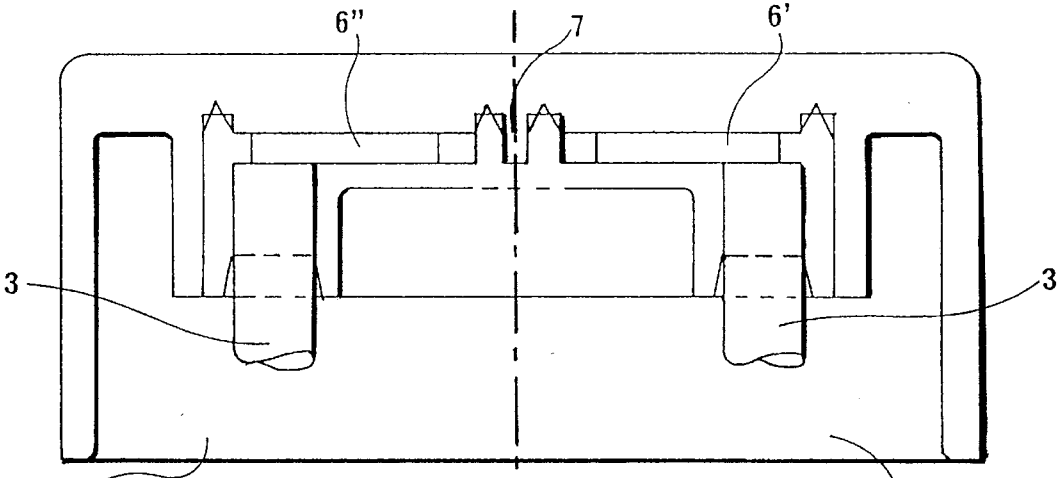
FIG. 5 is a side cross-sectional view of the dispenser of FIG. 3.
Figure 3:
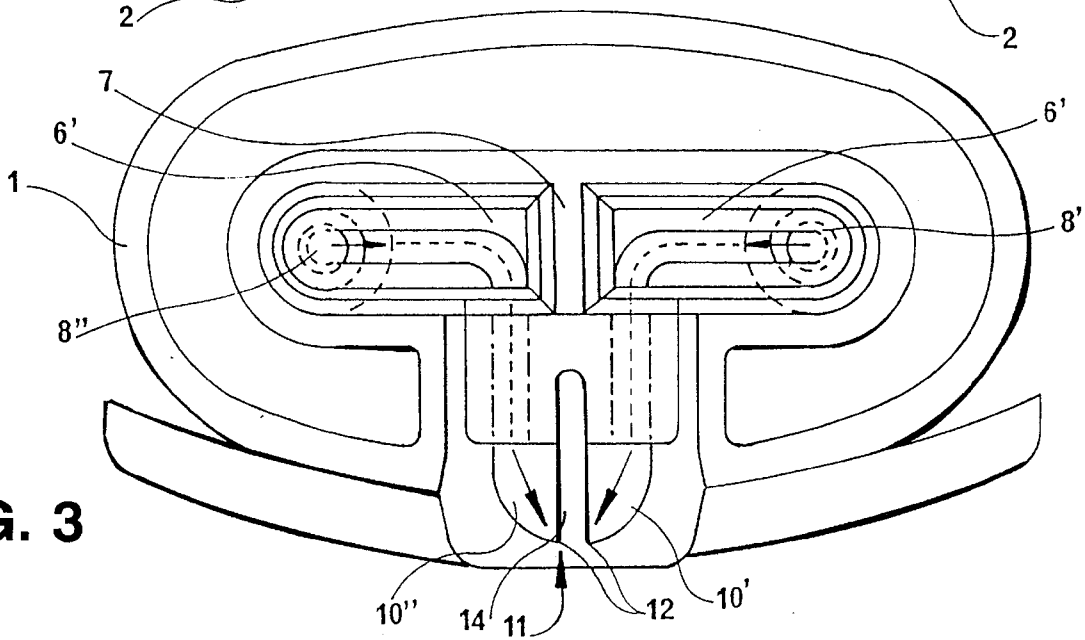
FIG. 3 is a section on line III—III of the dispenser according to FIG. 1.
Figure 4:
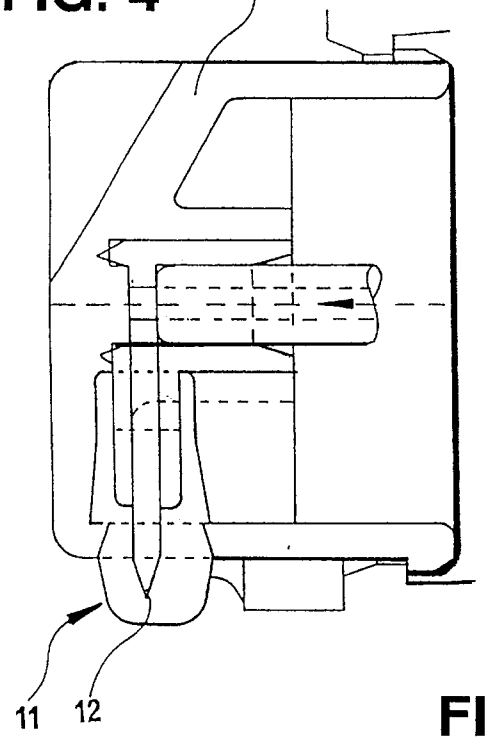
FIG. 4 is a lateral cross-sectional view of the upper end of the dispenser according to the invention.

The double dispenser comprises a casing 1 containing two reservoirs 2 which are totally independent from each other and can enclose different fluids; each reservoir 2 is provided with a pump 3 provided with a valve for simultaneous actuation with the other valve by a single pusher 5.

A dispensing member or nose 11 is mounted on said single pusher 5 and has an outlet slot forming two dispensing lips 13 which are provided to be able to separate elastically from each other under the pressure of the mixed fluid to be dispensed.

Preferably, the dispensing member is of an elastically deformable material and to this end is constituted by an injection-molded thermoplastic material having suitable elastic properties to ensure the elastic deformation of the lips 13 of the outlet slot of the nose 11.

The lips 13 ensure that the product remaining within the nose 11 is sheltered from the air and hence from any oxidation.

According to the invention, the outlets of the valves of the pumps 3 open into a chamber 6 of the single pusher 5 having a wall 7 dividing said chamber 6 into two chambers 6' and 6" receiving the respective fluids. Thus, when pressure is exerted on the single pusher 5, the two different fluids are brought in a separate manner to the chambers 6' and 6".

The wall 7 of the chamber 6 is preferably so formed as to have two outlet orifices 8' and 8" corresponding respectively to the chambers 6' and 6" and conducting the fluids separately into the cavities 10' and 10" respectively of the dispensing nose whence the two fluids are expelled in the form of a mixed fluid by the same and single outlet slot 12. The cavities 10' and 10" are separated by an intermediate partition 14 which is of one piece with the dispensing nose.

I claim:

1. In a double dispenser for fluid products, comprising, in a single casing (1), two chambers (2) filled with different fluids and each closed by a pump (3) provided with a valve, the two valves being actuated by a single pusher (5), said pusher (5) being provided with a chamber into which open outlets of the two valves, said chamber being divided by a wall (7) so as to form two separated chambers (6', 6") into which open respectively the outputs of the two valves, said wall (7) comprising two outlet openings (8', 8") respectively connected to said separate chambers (6', 6"), said outlet openings (8', 8") opening into cavities (10', 10") of a dispensing nose (11) of elastically deformable material, said dispensing nose (11) comprising an outlet slot (12) sealingly closed by two lips (13) arranged to spread under the pressure of the mixed fluid arriving respectively in the cavities (10', 10") during depression of the pusher (5); the improvement wherein the dispensing nose (11) comprises an intermediate partition (14) separating the cavities (10', 10").

2. A double dispenser according to claim 1, wherein the intermediate partition (14) is made of a single piece with the dispensing nose (11).

3. A double dispenser according to claim 1, wherein said wall (7) is fixed in the pusher (5).

4. A double dispenser according to claim 1, wherein the wall (7) extends within the pusher (5) to the cavities (10', 10") of the dispensing nose (11).

* * * * *